US007850463B2

(12) United States Patent
Werner et al.

(10) Patent No.: US 7,850,463 B2
(45) Date of Patent: Dec. 14, 2010

(54) FUSE BOX AND METHOD OF MAKING A FUSE BOX

(75) Inventors: Friedhelm Werner, Wuppertal (DE); Rainer Busies, Wuppertal (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/638,437

(22) Filed: Dec. 15, 2009

(65) Prior Publication Data

US 2010/0190360 A1 Jul. 29, 2010

(30) Foreign Application Priority Data

Jan. 26, 2009 (DE) ..... 10 2009 006 134

(51) Int. Cl.
*H01R 12/00* (2006.01)

(52) U.S. Cl. ..... 439/76.2; 439/949

(58) Field of Classification Search ..... 439/76.1, 439/76.2, 620.27, 949
See application file for complete search history.

(56) References Cited

U.S. PATENT DOCUMENTS 4,432,594 A * 2/1984 Daggett ..... 439/698
4,599,679 A 7/1986 Baader
4,721,862 A 1/1988 Cooper
4,842,534 A 6/1989 Mobley et al.
5,438,310 A 8/1995 Ikari
5,764,487 A 6/1998 Natsume
6,102,754 A 8/2000 Capper et al.
6,132,238 A 10/2000 Hartmann et al.
6,488,540 B2 12/2002 Coyle, Jr. et al.
6,824,398 B2 11/2004 Hara
7,198,524 B2 4/2007 Tsugane et al.
7,670,184 B2 * 3/2010 Akahori et al. ..... 439/620.27
2002/0086563 A1 7/2002 Cornell et al.
2002/0086564 A1 7/2002 Cornell et al.

FOREIGN PATENT DOCUMENTS

DE 3225319 A1 1/1984
DE 19618496 A1 11/1997
DE 19905717 A1 8/2000
DE 19963268 A1 6/2001
EP 0981181 A2 2/2000
EP 1018783 A2 7/2000
FR 27588659 A1 7/1998

* cited by examiner

*Primary Examiner*—Khiem Nguyen
(74) *Attorney, Agent, or Firm*—Brooks Kushman P.C.

(57) ABSTRACT

A fuse box has a housing in which a plurality of fuses are received. The housing defines a busbar cavity. A busbar has a plurality of integrally formed terminals, and is received in the busbar cavity of the housing. The housing and the busbar are arranged such that the plurality of integrally formed terminals on the busbar are positioned to directly receive corresponding contacts of the plurality of fuses.

19 Claims, 4 Drawing Sheets

FUSE BOX AND METHOD OF MAKING A FUSE BOX

CROSS-REFERENCE TO RELATED APPLICATIONS

This application claims foreign priority benefits under 35 U.S.C. §119(a)-(d) to DE 10 2009 006 134.7, filed Jan. 26, 2009, which is hereby incorporated by reference in its entirety.

BACKGROUND OF THE INVENTION

1. Field of the Invention

The invention relates to fuse boxes and fuse box busbars.

2. Background Art

The electrical system in an automobile includes one or more fuse boxes. In general, a fuse box for a plurality of fuses includes an electrically non-conductive housing for receiving the plurality of fuses. An electrically conductive busbar is disposed in the housing. Each fuse has a first end electrically connected to the busbar, and a second end electrically connected to an electrically isolating binding post.

One existing busbar assembly includes fixed terminals fastened to the busbar. Other existing applications include busbars made by stamping and bending.

Further background information may be found in U.S. Pub. Nos. 2002/0086564 and 2002/0086563. Further background information may also be found in U.S. Pat. Nos. 4,842,534, 7,198,524, 6,488,540, 6,132,238, 6,102,754, 4,599,679, 5,764,487, and 4,721,862.

SUMMARY OF THE INVENTION

The invention comprehends a combination of product features and process features for a fuse box busbar.

In one embodiment of the invention, a fuse box for a plurality of fuses comprises a housing for receiving the plurality of fuses. The housing defines a busbar cavity. A busbar has a plurality of integrally formed terminals. The busbar is received in the busbar cavity of the housing. The housing and the busbar are arranged such that the plurality of integrally formed terminals on the busbar are positioned to directly receive corresponding contacts of the plurality of fuses.

In some embodiments, the plurality of integrally formed terminals includes a plurality of female contacts. Each female contact is formed by a pair of adjacent contact elements integrally formed on the busbar. In some embodiments, the plurality of integrally formed terminals includes a plurality of male contacts. Each male contact is formed by a contact element integrally formed on the busbar.

Embodiments of the invention provide much flexibility. A cable may be connected to the busbar for providing electrical flow communication with the busbar. In one approach, the busbar has a coined area, and the cable is ultrasonically welded to the busbar at the coined area. In another way that embodiments of the invention provide flexibility, different busbars may be connected by clinching or welding. That is, a second busbar having a second plurality of integrally formed terminals may be received in the housing, and the second busbar is mechanically connected to the first busbar, for example, by clinching or welding. The different busbars in the housing may have different lengths. As well, it is possible to connect a busbar having female contacts with a busbar having male contacts.

In another embodiment of the invention, a fuse box for a plurality of fuses comprises a housing and a plurality of busbars. The housing is for receiving the plurality of fuses, and the housing defines a plurality of busbar cavities. Each busbar has a plurality of integrally formed terminals and is received in a corresponding busbar cavity of the housing. The housing and the plurality of busbars are arranged such that the plurality of integrally formed terminals on each busbar are positioned to directly receive corresponding contacts of the plurality of fuses.

Still further, in another embodiment of the invention, a fuse box busbar for use in a fuse box for a plurality of fuses comprises a busbar having a plurality of integrally formed terminals. The plurality of integrally formed terminals on the busbar are configured such that when the busbar is assembled into the fuse box, the plurality of integrally formed terminals are positioned to directly receive corresponding contacts of the plurality of fuses.

The advantages associated with embodiments of the invention are numerous. For example, a fuse box busbar made in accordance with the invention may require less material than an existing fuse box busbar, resulting in savings in space and weight. Further, the use of a flexible stamping die allows variations in the product design layout.

DETAILED DESCRIPTION OF THE PREFERRED EMBODIMENTS

FIGS. 1-11 illustrate example embodiments of the invention. It is appreciated that fuse boxes, busbars, and methods of making fuse boxes and busbars in accordance with embodiments of the invention may take various forms, and the drawings and below description describe examples.

Figure 1:
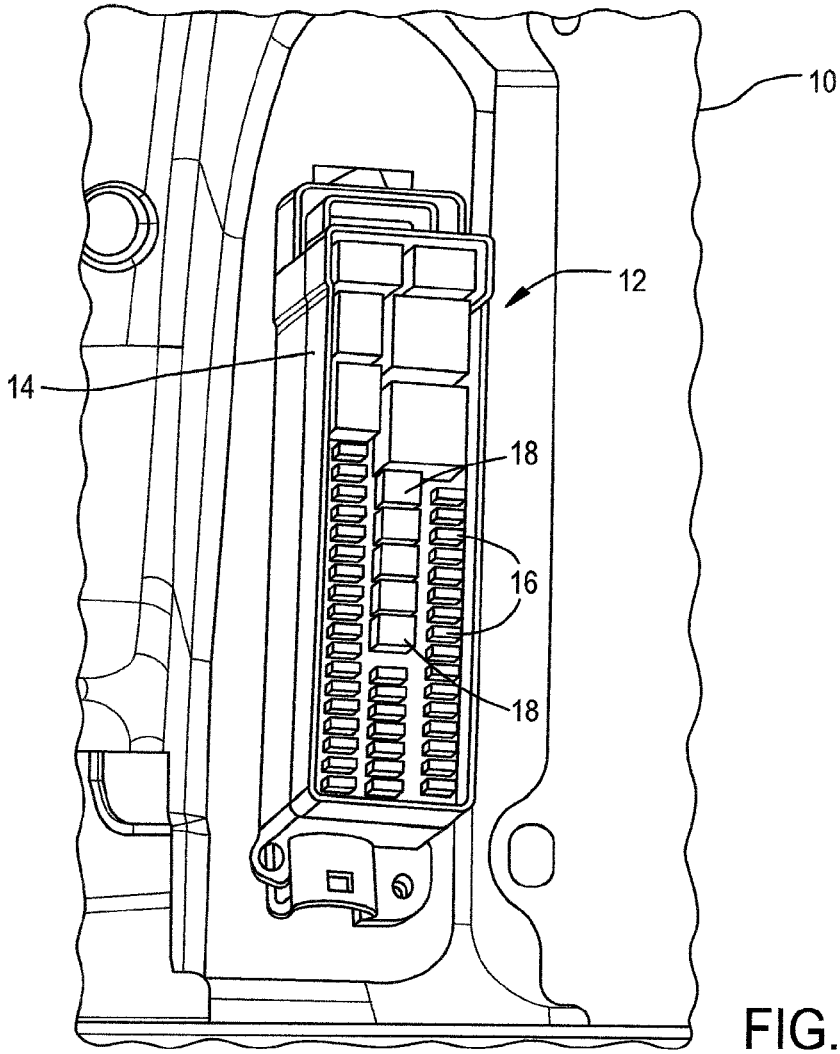
FIG. 1 illustrates a fuse box assembled onto a portion of an automobile, in an embodiment of the invention.
Figure 2:
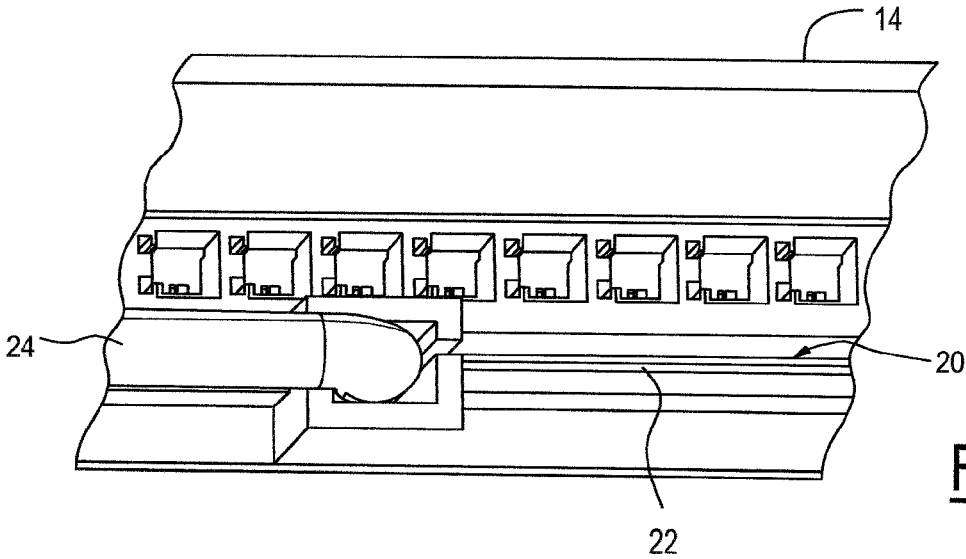
FIG. 2 illustrates the fuse box housing from the bottom, showing a busbar cavity receiving a busbar.

Referring to FIG. 1, a portion 10 of the automobile receives the fuse box 12. The fuse box 12 includes a housing 14 which receives a plurality of fuses 16 and 18. As shown, the fuses include MINI fuses 16 and JCASE fuses 18. As shown in FIG. 2, housing 14 is illustrated from the bottom, showing busbar 20 received in busbar cavity 22. Busbar cavity 22 is defined by the housing 14.

Also shown in FIG. 2 is a cable 24 connected to the busbar 20 for providing electrical flow communication with the busbar 20.

Figure 3:
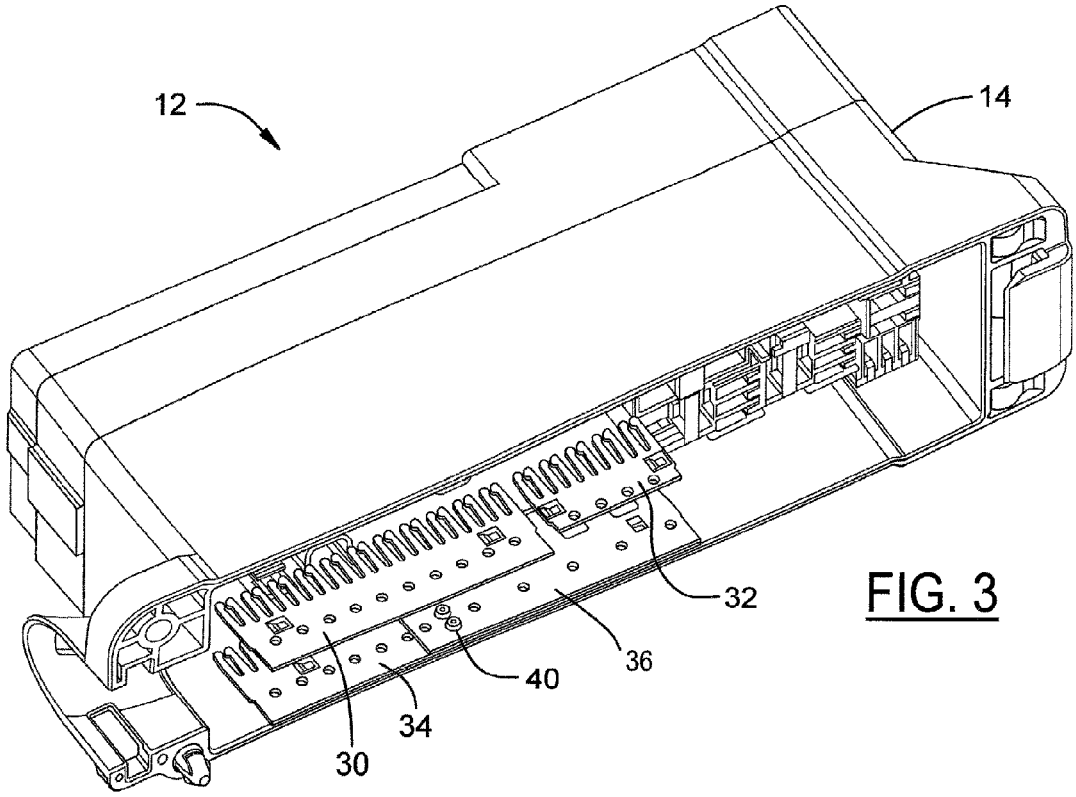
FIG. 3 is a perspective view of the fuse box, showing busbars of different sizes received in the fuse box housing.

FIG. 3 is a perspective view of the fuse box 12, showing housing 14 from the underside. Busbars 30, 32, 34, and 36 are visible. Each busbar has a plurality of integrally formed terminals. In FIG. 3, busbar 34 and busbar 36 are mechanically connected by clinching at 40.

Figure 4:
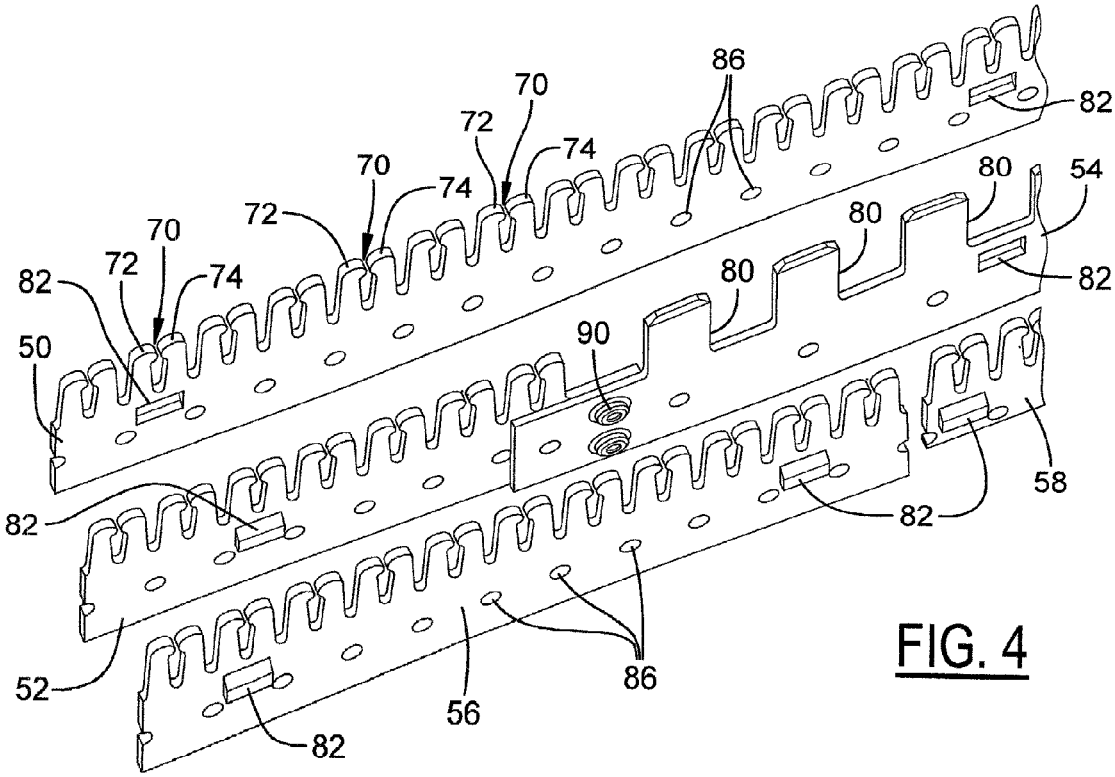
FIG. 4 illustrates the busbar layout for the fuse box, showing busbars of different lengths and shapes.

FIG. 4 illustrates the complete busbar layout including busbars 50, 52, 54, 56, and 58. Each busbar, for example, busbar 50, has a plurality of integrally formed terminals. Busbar 50 includes a plurality of integrally formed terminals in the form of female contacts 70. Each female contact 70 is formed by a pair of adjacent contact elements 72 and 74 formed on the busbar 50. On the other hand, busbar 54 includes integrally formed terminals in the form of male contacts, each male contact being formed by a contact element 80 formed integrally on the busbar 54. When the busbars are assembled to the housing, the plurality of integrally formed terminals (for example, terminals 70 and 80), are positioned to directly receive corresponding contacts of the plurality of fuses 16, 18 (FIG. 1).

With continuing reference to FIG. 4, locking features or devices 82 on the busbars are provided to engage (for example, snap-in locking devices engage cooperating structures on the housing) the housing 14 when the busbars are assembled to the housing 14. Feed holes 86 are provided to keep various additional processes in the correct pitch during processing. For example, feed holes 86 are used to feed the strip during processing. Also shown in FIG. 4, busbar 52 includes female contacts, while busbar 54 includes male contacts. Busbar 52 and busbar 54 are mechanically connected at clinch joint 90.

Figure 5:
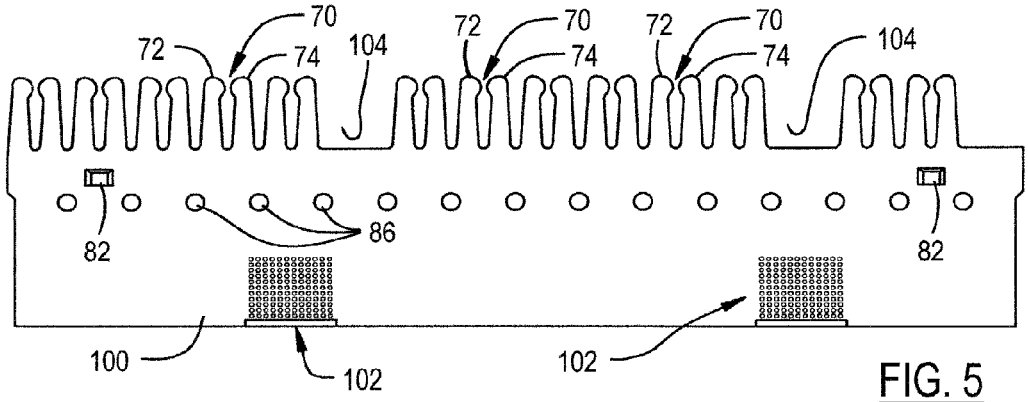
FIGS. 5-7 illustrate an overview of possibilities for female busbars, wherein busbars of any length and shape are producible with the same tooling.
Figure 6:
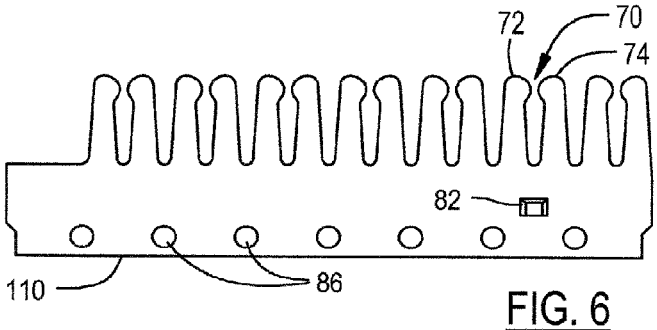
Figure 7:
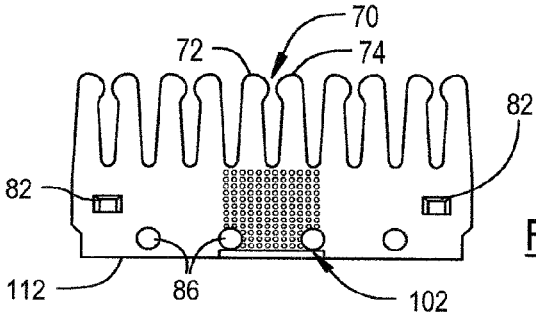

FIGS. 5-7 illustrate various busbars of various lengths and shapes produced at the same stamping die. FIG. 5 illustrates busbar 100. Busbar 100 includes female contacts 70 with each female contact 70 being formed by a pair of adjacent contact elements 72 and 74 integrally formed on the busbar 100. Busbar 100 further includes locking devices 82 and feed holes 86, as described previously. In addition, busbar 100 includes coined areas 102 and gaps 104 between groups of contacts.

FIG. 6 illustrates a different variation of a busbar at 110. Busbar 110 includes female contacts 70 formed by pairs of adjacent contact elements 72 and 74 formed on the busbar 110, as well as locking devices 82 and feed holes 86. Note that busbar 110, relative to busbar 100, has a reduced height. In FIG. 7, busbar 112 is depicted. Busbar 112 is similar to busbar 110 of FIG. 6. Busbar 112 includes female contacts 70 with each female contact being formed by a pair of adjacent contact elements 72 and 74, as well as locking devices 82 and feed holes 86. Busbar 112 further includes a coined area 102.

Figure 8:
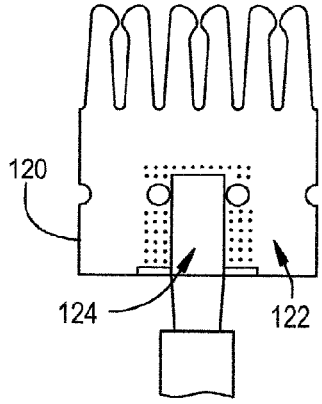
FIG. 8 illustrates a wire connected to the busbar by ultrasonic welding to a coined area on the busbar.
Figure 9:
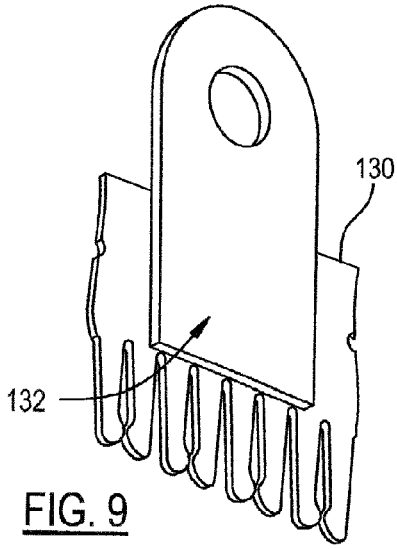
FIG. 9 illustrates an eyelet affixed to the busbar by a clinching process.
Figure 10:
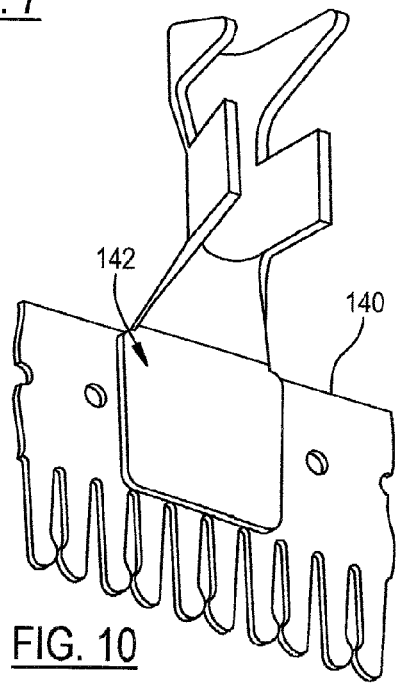
FIG. 10 illustrates a crimp transition affixed to the busbar by a clinching process.

FIGS. 8-10 illustrate additional arrangements for the busbars. In FIG. 8, busbar 120 includes coined area 122. A cable is connected at 124 to the busbar 120 for providing electrical flow communication with the busbar 120, and the cable is ultrasonically welded to the busbar 120 at the coined area 122. In FIG. 9, busbar 130 has an eyelet 132 connected to the busbar 130. The eyelet 132 is clinched to the busbar 130. In the alternative to a mechanical connection for eyelet 132, material connection is also possible. For example, ultrasonic-welding, resistance-welding, laser-welding, and soldering may be used to connect eyelet 132 to busbar 130. In FIG. 10, the busbar 140 has a crimp transition 142 connected to the busbar 140. The crimp transition 142 is clinched to the busbar 140 to allow a cable to be crimped to the crimp transition 142 to provide electrical flow communication with the busbar 140. In the alternative to a mechanical connection for crimp transition 142, material connection is also possible. For example, ultrasonic-welding, resistance-welding, laser-welding, and soldering may be used to connect crimp transition 142 to busbar 140.

Figure 11:
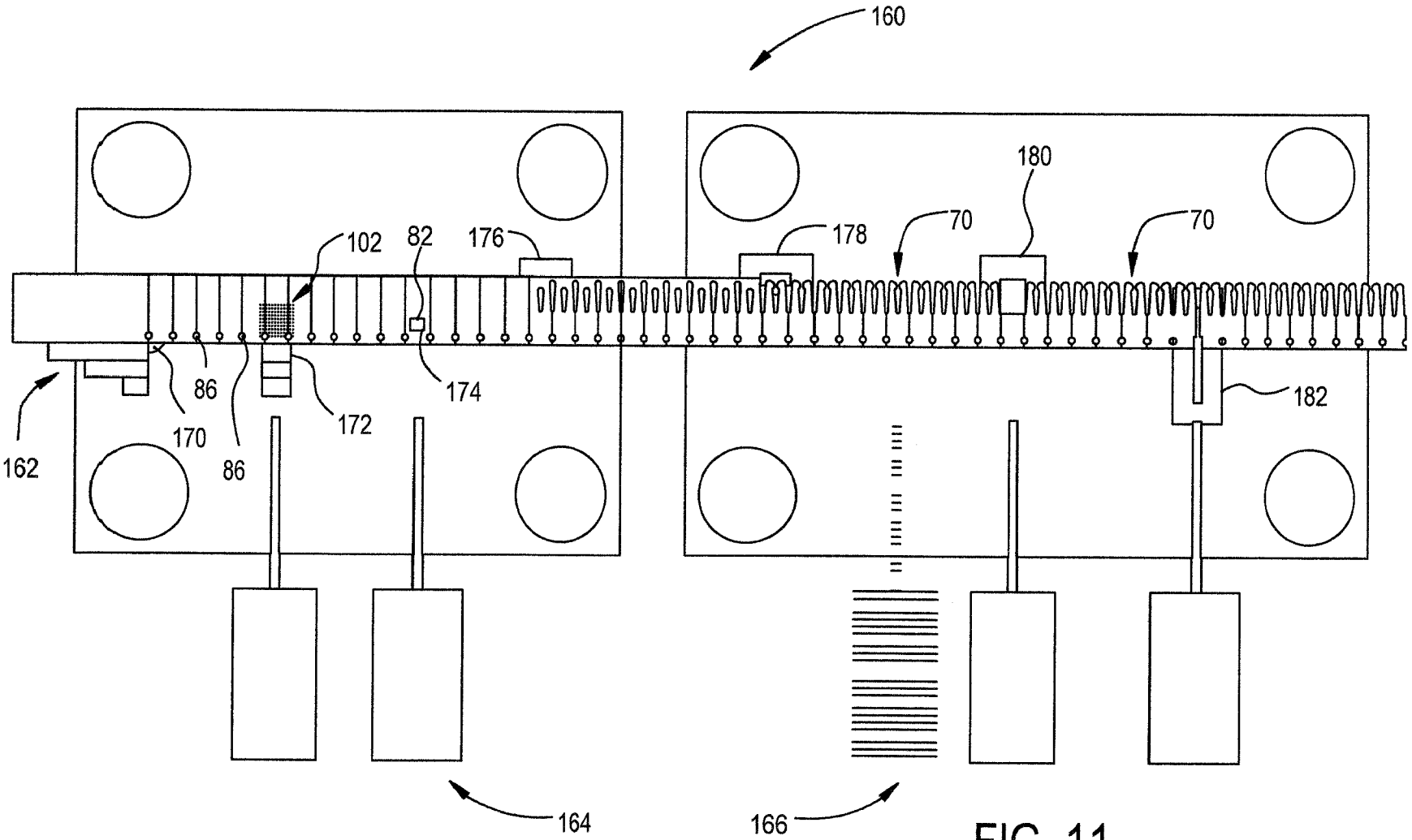
FIG. 11 illustrates a top view of the stamping die layout for producing busbars in embodiments of the invention.

FIG. 11 illustrates a top view of a stamping die layout 160 for producing busbars in accordance with the invention. As shown, stamping die layout 160 accommodates a variety of strip sizes, as shown at 162. Computer-controlled pneumatic elements 164 and 166 form the busbar as the strip is processed by layout 160. In more detail, feed holes 86 are produced by punch element 170. Coining areas 102 are produced by element 172. Locking devices 82 are produced by element 174. Elements 176, 178, and 180 together produce female contacts 70. Finally, element 182 is actuated to create busbars of varying lengths.

The advantages associated with the combination of product features and process features for a fuse box busbar contemplated by the invention are numerous. For example, a fuse box busbar may require less material, resulting in savings in space and weight. The feed holes 86 minimize pitch variations and allow controlled feeding direction without a carrier strip. The controlled punch elements in the stamping die layout allow much flexibility for a maximum amount of busbar versions.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fuse box for a plurality of fuses, the fuse box comprising:

a housing for receiving the plurality of fuses, the housing defining a busbar cavity; and a busbar in the form of a flat strip of a selected length, the busbar having a plurality of integrally formed terminals, the busbar being received in the busbar cavity of the housing, and the housing and the busbar being arranged such that the plurality of integrally formed terminals on the busbar are positioned to directly receive corresponding contacts of the plurality of fuses, wherein the length of the busbar is free of bends to create the busbar in the form of the flat strip.

2. The fuse box of claim 1 wherein the plurality of integrally formed terminals includes a plurality of female contacts, each female contact being formed by a pair of adjacent contact elements integrally formed on the busbar.

3. The fuse box of claim 1 wherein the plurality of integrally formed terminals includes a plurality of male contacts, each male contact being formed by a contact element integrally formed on the busbar.

4. The fuse box of claim 1 further comprising:

a cable connected to the busbar for providing electrical flow communication with the busbar.

5. The fuse box of claim 4 wherein the busbar has a coined area, and the cable is ultrasonically welded to the busbar at the coined area.

6. The fuse box of claim 1 further comprising:

a second busbar in the form of a flat strip of a selected length, the second busbar having a second plurality of integrally formed terminals, the second busbar being received in the housing, and the second busbar being mechanically connected to the first busbar, wherein the length of the second busbar is free of bends to create the second busbar in the form of the flat strip.

7. The fuse box of claim 6 wherein the second busbar is clinched to the first busbar.

8. The fuse box of claim 6 wherein the second busbar is welded to the first busbar.

9. The fuse box of claim 1 further comprising:

a second busbar in the form of a flat strip of a selected length, the second busbar having a second plurality of integrally formed terminals, the second busbar being received in the housing, wherein the length of the second busbar is free of bends to create the second busbar in the form of the flat strip; and wherein the length of the first busbar is different than the length of the second busbar.

10. The fuse box of claim 1 further comprising:

a second busbar in the form of a flat strip of a selected length, the second busbar having a second plurality of integrally formed terminals, the second busbar being received in the housing, wherein the length of the second busbar is free of bends to create the second busbar in the form of the flat strip, and the second busbar being mechanically connected to the first busbar;

wherein the plurality of integrally formed terminals on the first busbar includes a plurality of female contacts, each female contact being formed by a pair of adjacent contact elements integrally formed on the busbar; and wherein the second plurality of integrally formed terminals on the second busbar includes a plurality of male contacts, each male contact being formed by a contact element integrally formed on the second busbar.

11. The fuse box of claim 10 wherein the second busbar is clinched to the first busbar.

12. The fuse box of claim 10 wherein the second busbar is welded to the first busbar.

13. The fuse box of claim 1 wherein the busbar has a plurality of feed holes for use during manufacturing.

14. The fuse box of claim 1 wherein the busbar has a plurality of locking devices formed thereon for engaging the housing.

15. The fuse box of claim 1 further comprising:

an eyelet connected to the busbar.

16. The fuse box of claim 1 further comprising:

a crimp transition connected to the busbar to allow a cable to be crimped to the crimp transition to provide electrical flow communication with the busbar.

17. A fuse box for a plurality of fuses, the fuse box comprising:

a housing for receiving the plurality of fuses, the housing defining a plurality of busbar cavities; and a plurality of busbars, each busbar having a plurality of integrally formed terminals and being received in a corresponding busbar cavity of the housing, and the housing and the plurality of busbars being arranged such that the plurality of integrally formed terminals on each busbar are positioned to directly receive corresponding contacts of the plurality of fuses, wherein each busbar is in the form of a flat strip of a selected length that is free of bends.

18. The fuse box of claim 17 wherein the plurality of busbars includes at least one busbar wherein the plurality of integrally formed terminals includes a plurality of female contacts, each female contact being formed by a pair of adjacent contact elements integrally formed on the busbar.

19. The fuse box of claim 17 wherein the plurality of busbars includes at least one busbar wherein the plurality of integrally formed terminals includes a plurality of male contacts, each male contact being formed by a contact element integrally formed on the busbar.

* * * * *